US009726338B1

(12) United States Patent
Fu et al.

(10) Patent No.: US 9,726,338 B1
(45) Date of Patent: Aug. 8, 2017

(54) MOUNTING KIT FOR WALL MOUNTED LIGHT FIXTURES

(71) Applicant: Kuna Systems Corporation, San Bruno, CA (US)

(72) Inventors: Sai-Wai Fu, Los Altos, CA (US); Haomiao Huang, Redwood City, CA (US)

(73) Assignee: KUNA SYSTEMS CORPORATION, San Bruno, CA (US)

( * ) Notice: Subject to any disclaimer, the term of this patent is extended or adjusted under 35 U.S.C. 154(b) by 205 days.

(21) Appl. No.: 14/664,275

(22) Filed: Mar. 20, 2015

(51) Int. Cl.
*F21S 8/00* (2006.01)
*F21V 21/02* (2006.01)

(52) U.S. Cl.
CPC ..... *F21S 8/036* (2013.01); *F21V 21/02* (2013.01)

(58) Field of Classification Search
CPC ..... F21S 8/036; F21V 21/02
USPC ..... 362/432
See application file for complete search history.

(56) References Cited

U.S. PATENT DOCUMENTS 5,442,132 A * 8/1995 Sandell ..... F21V 21/02 174/54
6,116,564 A 9/2000 Cates ..... 248/544

* cited by examiner

*Primary Examiner* — Elmito Breval
*Assistant Examiner* — Hana Featherly
(74) *Attorney, Agent, or Firm* — Christopher P. Maiorana, PC

(57) ABSTRACT

An apparatus configured to indicate a length of extension for screws extending from a bracket, comprising (A) a first portion at one end, (B) a second portion having a depth, (C) a third portion having a length, (D) a fourth portion having the depth and (E) a fifth portion at another end. The first portion may be connected perpendicularly to the second portion. The second portion may be connected perpendicularly to the third portion. The third portion may be connected perpendicularly to the fourth portion and away from the first portion. The fourth portion may be connected perpendicularly to the fifth portion and away from the first portion. The depth offsets the third portion from the first portion and the fifth portion by a distance equal to a thickness of a base of a light fixture plus a depth of a locking nut for the screws.

16 Claims, 9 Drawing Sheets

MOUNTING KIT FOR WALL MOUNTED LIGHT FIXTURES

FIELD OF THE INVENTION

The present invention relates to fixture installations generally and, more particularly, to an apparatus and/or mounting kit for use when wall mounting a light fixture.

BACKGROUND OF THE INVENTION

Generally, home owners do not have experience or special tools for working with a bulky light fixture. Installing a light fixture involves connecting wires and mounting the light fixture to a wall or ceiling. Usually home owners have to improvise or ask for a second hand to help, which wastes time and resources. Installing a light fixture alone can be frustrating. In the United States, installation of light fixtures happens about 10 million times each year.

Wall mounted light fixture can be purchased from major Do It Yourself (DIY) stores. However, the light fixtures generally do not provide any tools to help users mount the fixture to the wall. Without an installation kit, a typical user has to ask someone to hold the light fixture while both hands are used to perform the power wiring connection to the power wires from the junction box in the wall. Installation typically takes from 5 to 15 minutes while the person helping has to hold a large fixture, resulting in arm fatigue and/or frustration.

After the power wiring is done, the user typically mounts the light fixture to the wall with mounting screws attached to a bracket in the junction box. Adjusting a length of extension of the mounting screws without any tools is a trial and error process. Users typically take 3 attempts to adjust the mounting screws. In each attempt, the user removes the light fixture and holds the light fixture up in the air while adjusting the length of the extension of the mounting screws. The trial and error process can be extremely frustrating and time consuming.

It would be desirable to implement a mounting kit for wall mounted light fixtures.

SUMMARY OF THE INVENTION

The present invention concerns an apparatus configured to indicate a length of extension for screws extending from a bracket, comprising (A) a first portion at one end of the apparatus, (B) a second portion having a depth, (C) a third portion having a length, (D) a fourth portion having the depth and (E) a fifth portion at another end of the apparatus. The first portion may be connected perpendicularly to the second portion. The second portion may be connected perpendicularly to the third portion. The third portion may be connected perpendicularly to the fourth portion and away from the first portion. The fourth portion may be connected perpendicularly to the fifth portion and away from the first portion. The first portion, the second portion, the third portion, the fourth portion and the fifth portion are arranged in a common plane. The length of the third portion is at least a same length as the bracket. The first portion and the fifth portion are arranged in a line. The depth offsets the third portion from the first portion and the fifth portion by a distance equal to a thickness of a base of a light fixture plus a depth of a locking nut for the screws.

The objects, features and advantages of the present invention include providing a mounting kit that may (i) be used for a wall mounted light fixture installation, (ii) reduce frustration for DIY home owners (iii) reduce an installation time (e.g., about an hour), (iv) determine a length of extension for mounting screws without trial and error, (v) safely suspend the light fixture while the user connects wires, (vi) free up the hands of the user while connecting wires and/or (vii) help users install light fixtures when alone.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

Figure 1:
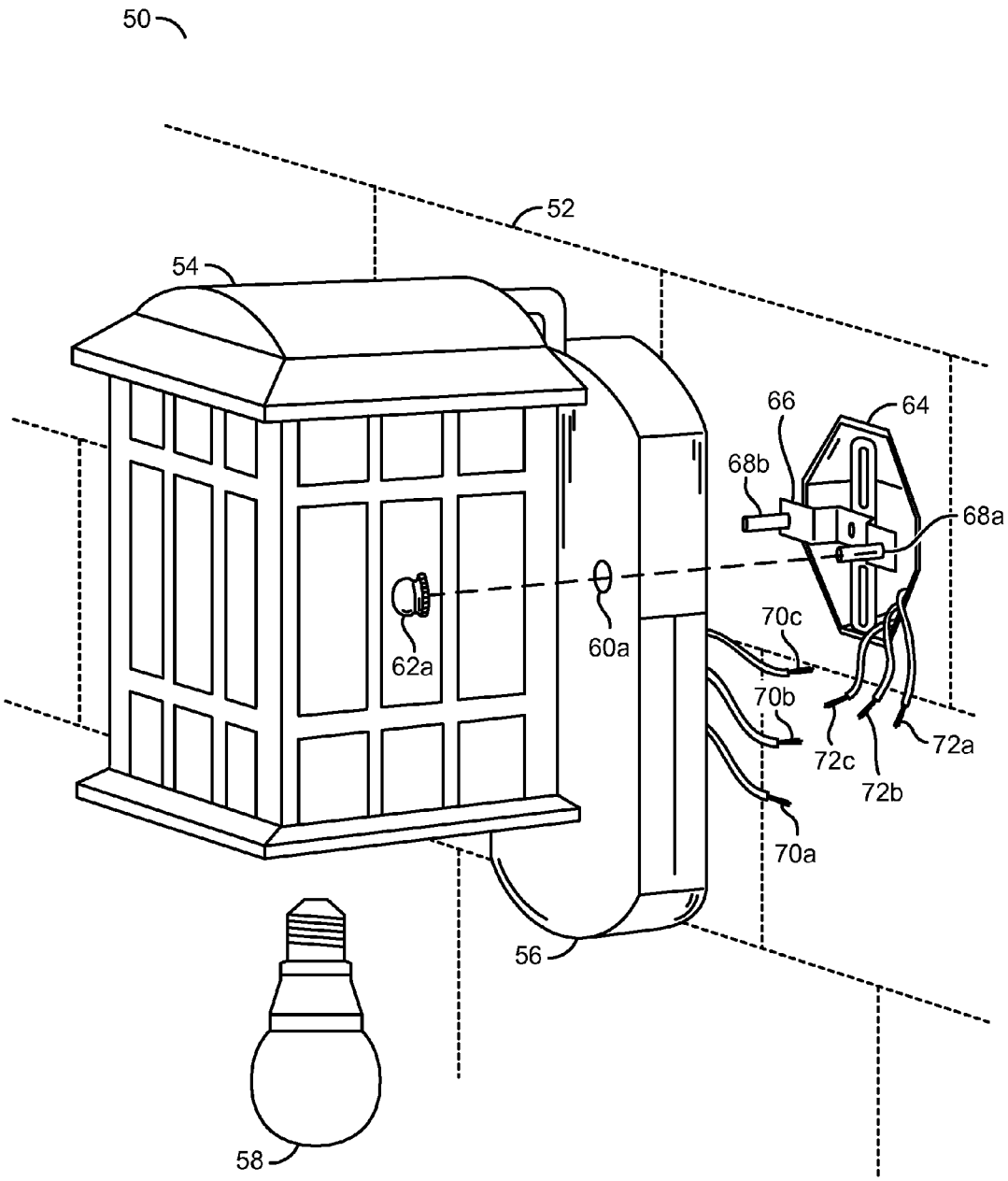
FIG. 1 is a diagram of an example installation of a light fixture mounting for a wall bracket.

Referring to FIG. 1, a diagram of an example installation 50 of a light fixture mounted on a wall bracket is shown. The example installation 50 comprises a wall 52, a light fixture 54, a wall mount base 56, a light bulb 58, a mounting hole 60*a*, a locking nut 62*a*, a junction box 64, a bracket 66, mounting screws 68*a*-68*b*, fixture wires 70*a*-70*c* and/or power wires 72*a*-72*c*.

Generally, the light fixture 54 is mounted to the wall 52. The wall mount base 56 is typically designed to cover the junction box 64. Before covering the junction box 64 with the wall mount base 56, the light fixture 54 should be adequately supported (e.g., to prevent the light fixture 54 from falling) and/or appropriate wiring connections should be made (e.g., to provide power to the light bulb 58).

The bracket 66 may be removably attached to the junction box 64. The bracket 66 may provide support for the light fixture 54. The mounting screws 68*a*-68*b* may be removably attached to the bracket 66. A length of extension of the mounting screws 68*a*-68*b* from the bracket 66 may be adjusted. For example, the length of extension of the mounting screws 68*a*-68*b* may be adjusted to accommodate wall mount bases having varying sizes. While two mounting screws 68*a* and 68*b* are shown, the particular number of mounting screws may be varied to meet the design criteria of a particular implementation. For example, a heavier fixture 58 may need more screws.

The mounting screws 68*a*-68*b* may be configured to support the light fixture 54. The wall mount base 56 may have one or more mounting holes. The mounting hole 60*a* is shown. The mounting hole 60*a* may be an aperture wide enough to fit the mounting screw 68*a*. The mounting screw 68*a* may fit through the mounting hole 60*a*. A similar mounting hole (e.g., a mounting hole 60*b*, not shown) may be available for the mounting screw 68*b*. Using the mounting holes 60*a*-60*b*, the mounting screws 68*a*-68*b* may be removably connected with the wall mount base 56 to support the light fixture 54.

The mounting screws 68*a*-68*b* may extend through the mounting holes 60*a*-60*b*. The locking nut 62*a* may removably attach to the mounting screw 68*a* to prevent the wall mount base 56 from slipping off the mounting screw 68*a*. Similarly a locking nut (e.g., a locking nut 62*b*, not shown) may removably attach to the mounting screw 68*b*. The locking caps 62*a*-62*b* may further provide a decorative function. The decorative function of the locking caps 62*a*-62*b* may be to hide the mounting screws 68*a*-68*b* from view.

The length of extension of the mounting screws 68*a*-68*b* may need to meet a particular range of precision (e.g., within 2 mm). The length of extension of the mounting screws 68*a*-68*b* may need to be long enough to provide adequate support for the light fixture 54 (e.g., long enough to feed through the mounting holes 60*a*-60*b*). The length of extension of the mounting screws 68*a*-68*b* may need to be short enough to be covered by the locking nuts 62*a*-62*b* (e.g., short enough so that the locking nuts 62*a*-62*b* cover the mounting screws 68*a*-68*b* without exposing a portion of the mountings screws 68*a*-68*b*). Determining a precise length of extension of the mounting screws 68*a*-68*b* may be difficult and/or time consuming for a user (e.g., a home owner).

The fixture wires 70*a*-70*c* are shown extending from the wall mount base 56. The power wires 72*a*-72*c* are shown extending from the junction box 64. Connecting the fixture wires 70*a*-70*c* to the power wires 72*a*-72*c* provides power from a source (e.g., a home electrical supply) to the light fixture 54 (e.g., to power the light bulb 58). During installation of the light fixture 54, the user connects the fixture wires 70*a*-70*c* to the power wires 72*a*-72*c*. The wall mount base 56 and/or the junction box 64 hide the fixture wires 70*a*-70*c* and the power wires 72*a*-72*c* (e.g., the wiring is inaccessible after the installation of the light fixture 54). Generally, the length of the fixture wires 70*a*-70*c* and/or the power wires 72*a*-72*c* limit a distance of the light fixture 54 from the junction box 64 during installation.

Figure 2:
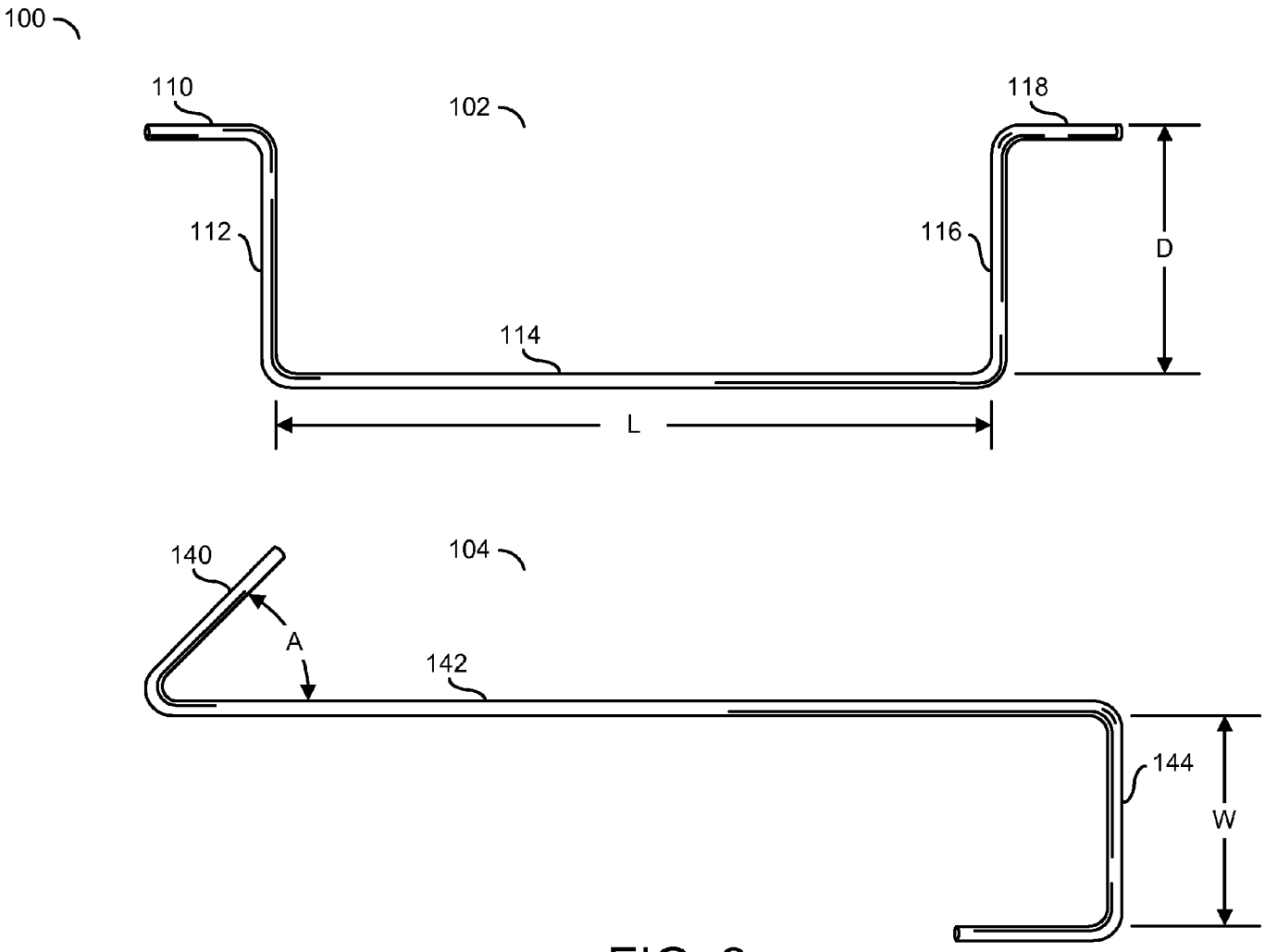
FIG. 2 is a diagram illustrating an embodiment of an installation kit.

Referring to FIG. 2, a diagram of an installation kit 100 is shown in accordance with an embodiment of the present invention. The installation kit 100 may comprise a first apparatus (or tool) 102 and a second apparatus (or tool) 104. The first apparatus 102 may be an indication tool (e.g., a screw length indicator). The second apparatus 104 may be a hook. The indication tool 102 may be made from, in one example, a metal bar. However, the particular type of material used to make the indication tool 102 may be varied to meet the design criteria of a particular implementation. The indication tool 102 may be configured to indicate a length of extension for the mounting screws 68*a*-68*b*. The indication bar 102 generally comprises a portion 110, a portion 112, a portion 114, a portion 116 and a portion 118. The portion 110, the portion 112, the portion 114, the portion 116 and the portion 118 are arranged in a common plane (e.g., the indication bar 102 lies flat).

The portion 110 may be at one end of the indication bar 102. The portion 118 may be at another (e.g., the opposite) end of the indication bar 102. Generally, the portion 110 and the portion 118 are bent away from each other (e.g., the unconnected end of the portion 110 and the unconnected end of the portion 118 point in opposite directions). For example, the portion 110 is shown pointing to a left side of the indication tool 102 and the portion 118 is shown pointing to a right side of the indication bar 102. Generally, a length of the portion 110 and/or the portion 118 may be a length sufficient to provide support for the tool 102 (e.g., when pressed against the wall 52).

The portion 112 is shown connected perpendicularly to the portion 110 and connected perpendicularly to the portion 114. The perpendicular connection of the portion 112 to the portion 114 is directed away from the portion 110. For example, the portion 110 is shown pointing to the left from the connection with the portion 112 and the portion 114 is shown pointing to the right from the connection with the portion 112 (e.g., the portion 110, the portion 112 and the portion 114 form a general 'Z' shape rather than a 'U' shape).

The portion 114 is shown connected perpendicularly to the second portion 112 and the portion 116. The portion 112 and the portion 116 are shown pointing in the same direction (e.g., the portion 112, the portion 114 and the portion 116 form a general 'U' shape). The portion 114 is shown having a length L. The length L may be at least the same length as the bracket 66. For example, the portion 112, the portion 114 and the portion 116 may be configured to fit around the bracket 66. Generally, the length L will be longer than the length of the bracket 66.

The portion 116 is shown connected perpendicularly to the portion 114 and connected perpendicularly to the portion 118. The perpendicular connection of the portion 116 to the portion 118 is directed away from the portion 110. For example, the portion 110 is shown pointing to the left from the connection with the portion 112 and the portion 118 is shown pointing to the right from the connection with the portion 116 (e.g., the portion 110 and the portion 118 point in opposite directions).

The perpendicular connection of the portion 116 to the portion 114 is directed away from the portion 114. For example, the portion 110 is shown pointing to the left from the connection with the portion 116 and the portion 118 is shown pointing to the right from the connection with the portion 116 (e.g., the portion 114, the portion 116 and the portion 118 form a general 'Z' shape).

The portion 112 and the portion 116 are shown having a depth measurement D. The portion 112 and the portion 116 may have the same depth D. The depth D may offset the portion 114 from the portion 110 and the portion 118. The depth D may be equal (or close) to a thickness of the wall mount base 56 of the light fixture 54 plus a depth of the locking nuts 62*a*-62*b*. In some embodiments, the depth D may be selected so that when the portion 110 and the portion 118 are set against the wall 52, the length of extension for the mounting screws 68*a*-68*b* may be adjusted until the mounting screws 68*a*-68*b* touch the portion 114. When the mounting screws 68*a*-68*b* touch the portion 114, the mounting screws 68*a*-68*b* may be at the precise length (e.g., within a range of 2 mm) to mount the light fixture 54 and attach the locking nuts 62*a*-62*b*. The mounting screws 68*a*-68*b* are described as touching the portion 114. However, the tool 102 may still work if the mounting screws 68*a*-68*b* are close to touching the portion 114.

The indication tool 102 (e.g., the screw length indicator) may be used to determine a length of extension of the mounting screws 68*a*-68*b* attached to and extending from the bracket 66. For example, the extension requirement for a particular model of light fixture (e.g., the light fixture 54) may be within a 2 mm precision range. The length of extension may take into account a distance from the surface of the wall 52 to go through the thickness of the wall plate base 56 (e.g., through the mounting hole 60*a*) plus the depth of the locking nut 62*a*. A typical home owner may not intuit that the length of extension requirement for the mounting screws 68*a*-68*b* are not dependent on the base of the mounting screws 68*a*-68*b* because the mounting screws 68*a*-68*b* are mounted on the bracket 66 which may vary in distance from the surface of the wall 52 (e.g., typically by about 25 mm).

The length of mounting screws 68*a*-68*b* may be adjusted. The length of extension of the mounting screws 68*a*-68*b* for installation of the light fixture 54 may be based on a depth of a base 56 of the light fixture 54. For example, the extension of the mounting screws 68*a*-68*b* may need to be adjusted to within 2 mm from a surface of the wall 52 to allow the locking nuts 62*a*-62*b* to hold the light fixture 54 securely to the wall 52 (and hide the mounting screws 68*a*-68*b* from view).

The hook 104 may be configured to suspend the light fixture 54. The hook 104 generally comprises a hook portion 140, a hook portion 142 and a hook portion 144. The hook portion 140 may be at one end of the hook 104. The hook portion 144 may be at another end of the hook 104. The hook portion 140, the hook portion 142 and the hook portion 144 may be arranged in a common plane (e.g., the hook 104 may lie flat on a surface).

The hook portion 140 is shown connected to the hook portion 142 at an acute angle A. The angle A may be selected such that the hook portion 140 may fit over (e.g., hook over and/or hang from) the bracket 66. Fitting the hook portion 140 over the bracket 66 may allow the hook 104 to provide support for an object (e.g., the light fixture 54) attached to the hook portion 144. A length of the hook portion 140 may be selected to provide enough space for the hook 104 to hang over the bracket 66 without slipping.

The hook portion 142 may be connected perpendicularly to the hook portion 144. The perpendicular connection of the hook portion 142 to the hook portion 144 may be directed away from the hook portion 140. For example, the hook portion 140 is shown bent towards a general upwards direction. The hook portion 144 is shown bent towards a general downwards direction. A length of the hook portion 142 may be selected to provide enough distance between the hook portion 140 and the hook portion 144 for the user to have enough space to comfortably connect the fixture wires 70*a*-70*c* and/or the power wires 72*a*-72*c* while the hook 104 suspends the light fixture 54 in the air.

The hook portion 144 is shown having a perpendicular bend. The perpendicular bend of the hook portion 144 may be directed towards the hook portion 140. For example, the hook portion 142 and the hook portion 144 may create a general 'U' shape. The hook portion 144 may be configured to fit into one of the mounting holes 60*a*-60*b* of the base 56. Fitting the hook portion 144 into one of the mounting holes 60*a*-60*b* while the hook portion 140 is removably attached to the bracket 66 may allow the hook 104 to suspend the light fixture 54 in the air.

The hook portion 144 is shown having a width W. The width W may be selected to correspond to a shape of the base 56. For example, the width W may be configured to be wide enough for the third hook portion 144 to reach around the base 56 so that the third hook portion 144 can reach one of the mounting holes 60*a*-60*b*. The width W may be selected based on a distance from one of the mounting holes 60*a*-60*b* to an edge of the base 56 of the light fixture 54.

The hook tool 104 may be configured to fit into one of the two mounting holes 60*a*-60*b* (e.g., the holes for the mounting screws 68*a*-68*b*) on the base 56 of the light fixture 54. The mounting holes 60*a*-60*b* may be at a location on the base 56 for the hook 104 to balance the light fixture 54 (e.g., horizontally) and close enough to the junction box 64 while the user connects the fixture wires 70*a*-70*c* to the power wires 72*a*-72*c*. Balancing the light fixture 54 horizontally may suspend the light fixture 54 safely in the air. Suspending the light fixture 54 in the air may free up the hands of the user for connecting the wiring. The hook 104 may be designed to securely fit in the mounting screw holes 60*a*-60*b* and/or any other aperture of the base 56.

Figure 3:
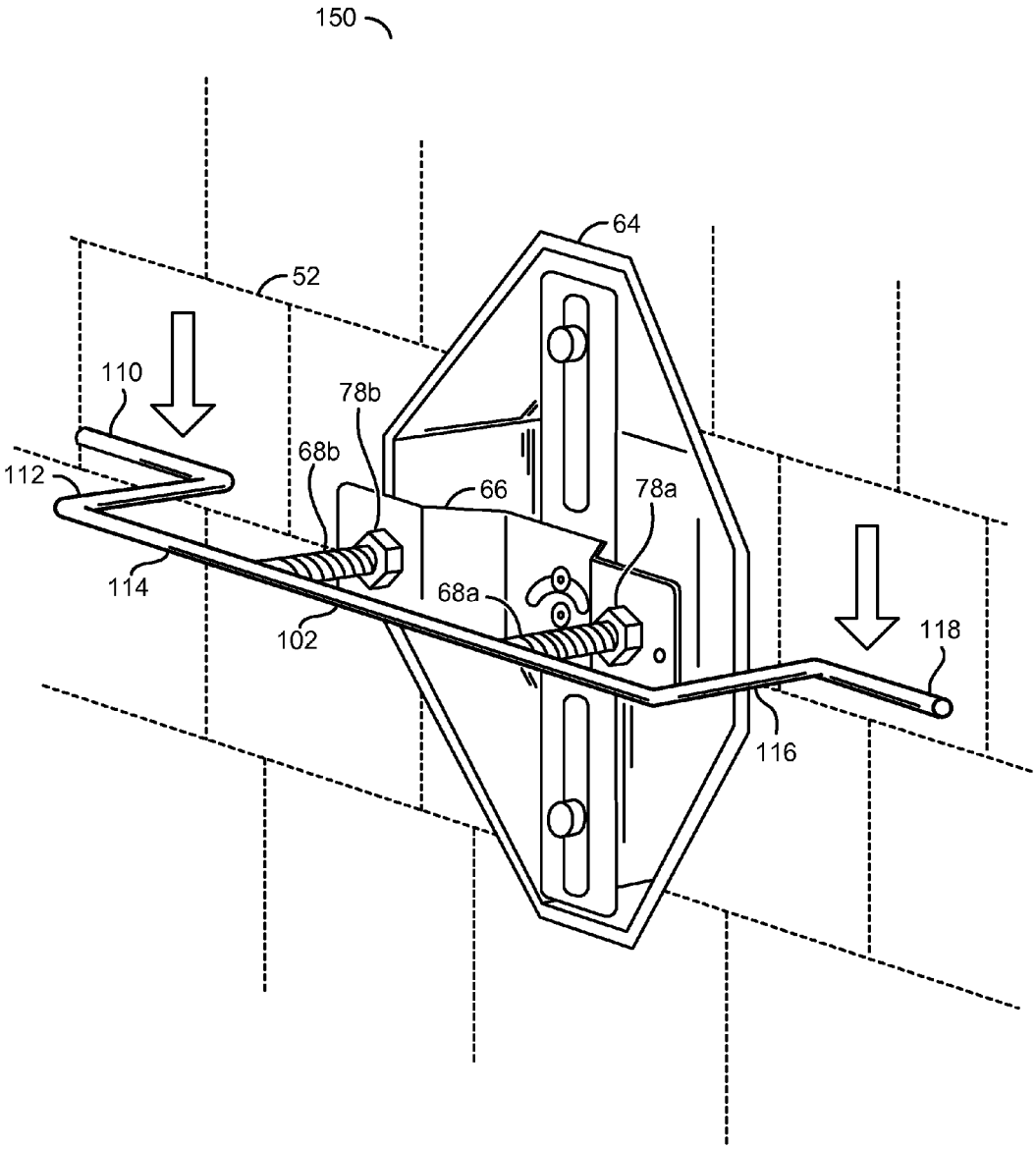
FIG. 3 is a diagram of an indicator bar showing a length of extension for screws.

Referring to FIG. 3, a diagram illustrating an example 150 of the indicator bar 102 indicating the length of extension for the mounting screws 68*a*-68*b* is shown. The portion 110 and the portion 118 are shown generally touching the wall 52. The portion 114 is shown near the end of the mounting screw 68*a* and the mounting screw 68*b*. The mounting screw 68*a* and the mounting screw 68*b* are generally twisted within the bracket 66 until the mounting screw 68*a* and the mounting screw 68*b* are touching, or close to touching the portion 114*a*. A screw 78*a* is then generally tightened onto the mounting screw 68*a*. Similarly, a screw 78*b* is then generally tightened onto the mounting screw 68*b*.

When the screw 78*a* and the screw 78*b* are tightened and the mounting screws 68*a*-68*b* are touching (or close to touching) the indicator bar 102, the length of extension of the mounting screws 68*a*-68*b* may be at a proper length (e.g., within a 2 mm range) for mounting the light fixture 54. The user may remove the indicator tool 102 from the wall 52.

The example 150 illustrates one embodiment of the indicator bar 102 having a fixed depth D. For example, the indicator bar 102 may be packaged as an installation accessory for a particular model of the light fixture 54. The depth D and/or the length L of the indicator bar 102 may be set (e.g., selected) for use with one particular type of model of the light fixture 54 (e.g., based on the thickness of the wall mount base 66 and the size of the locking nuts 62*a*-62*b*). The depth D and/or the length L of the indicator bar 102 may be varied according to the design criteria of a particular implementation.

Figure 4:
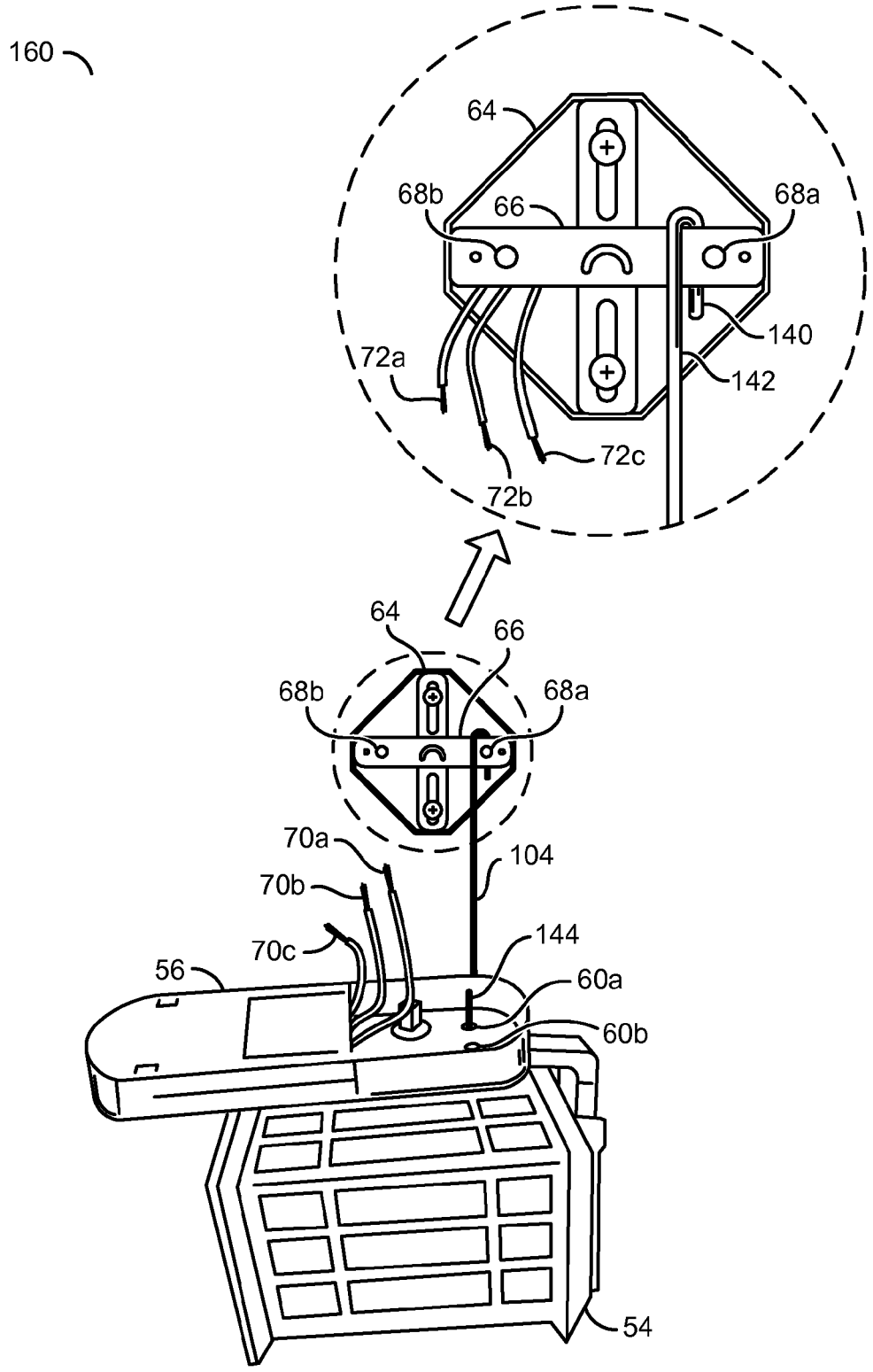
FIG. 4 is a diagram of a hook suspending a light fixture from a bracket.

Referring to FIG. 4, a diagram illustrating an example 160 of the hook tool 104 suspending the light fixture 54 from the bracket 66 is shown. The light fixture 54 is shown suspended horizontally in the air. Suspending the light fixture 54 may allow the user to connect the fixture wires 70*a*-70*c* to the power wires 72*a*-72*c* without having to use one hand to hold up the light fixture and/or without having a helper hold the light fixture 54.

The power wires 72*a*-72*c* are shown extending from the junction box 64. The fixture wires 70*a*-70*c* are shown extending from the base 56. The hook 104 may be configured to hold up the light fixture 54 close enough to the junction box 64 such that the fixture wires 70*a*-70*c* may reach the power wires 72*a*-72*c*. For example, a length of the hook portion 142 may be selected based on a length of wiring provided for the fixture wires 70*a*-70*c*.

The hook 104 is shown hanging from the bracket 66. The hook portion 140 is shown hanging over (e.g., hooking onto) the bracket 66. The hook portion 142 is shown extending downwards towards the light fixture 54. The hook portion 144 is shown reaching below the base 56. The hook portion 144 is shown extending up through the wall mount hole 60*a*. In some embodiments, the hook portion 144 may extend up through the wall mount hole 60*b* (e.g., according to a preference of the user installing the light fixture 54).

Extending the hook portion 144 up through the mounting hole 60*a* (or 60*b*) may allow the hook tool 104 to removably attach to the base 56 to provide support for the light fixture 54. The base 56 may have other apertures available for the hook portion 144. The location of the mounting holes 60*a*-60*b* and/or any other holes may be varied according to the design criteria of a particular implementation.

Figure 5:
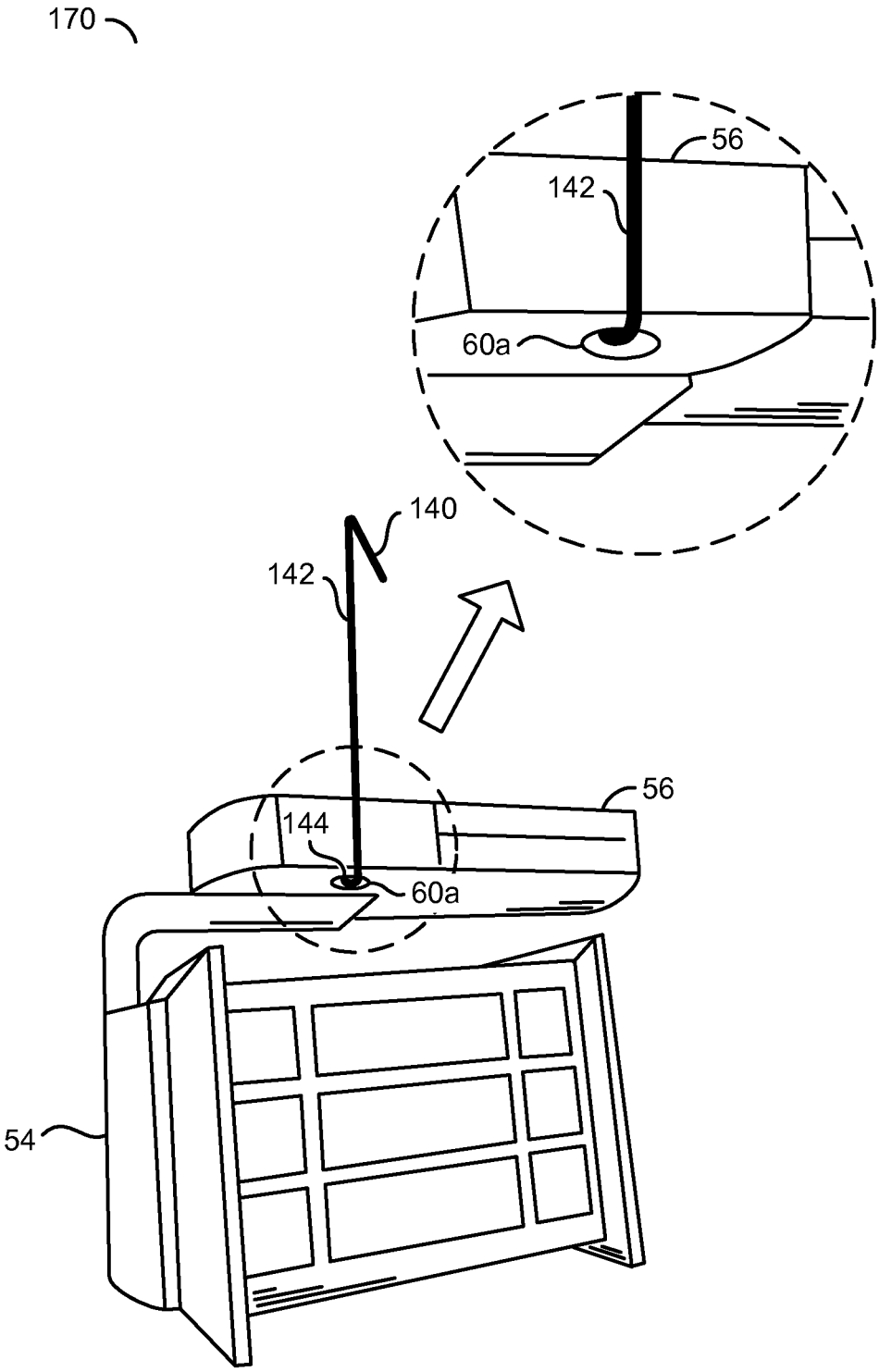
FIG. 5 is a diagram of an alternate view of a hook suspending a light fixture.

Referring to FIG. 5, diagram illustrating an alternate view 170 of the hook tool 104 suspending the light fixture 54 is shown. The alternate view 170 shows the hook portion 142 extending downwards from the hook portion 140 to allow the hook tool 104 to reach below the wall mount base 56. The hook portion 144 is shown extending under the wall mount base 56 and extending upwards through the wall mount hole 60*a*. In some embodiments, the wall mount hole 60*b* may be used for hooking the light fixture 54 to the hook tool 104 (e.g., by reversing the light fixture 54).

Figure 6:
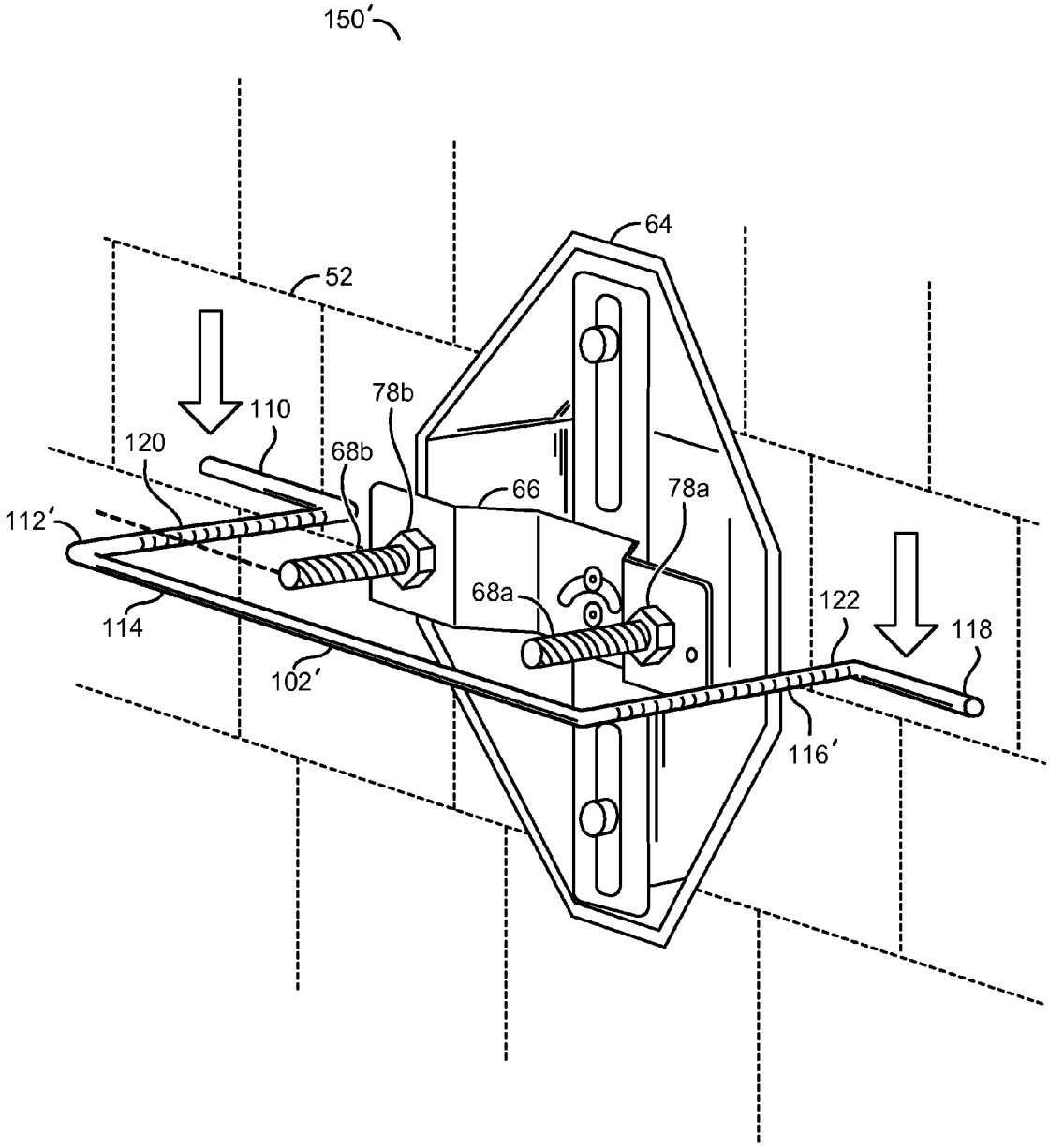
FIG. 6 is a diagram illustrating an alternate embodiment of an indication bar.

Referring to FIG. 6, a diagram illustrating an example 150' of a universal indicator bar 102' indicating the length of extension for the mounting screws 68*a*-68*b* is shown. The universal indicator bar 102' is shown having a portion 112' and a portion 116'. The portion 112' is shown having markings (e.g., ruler and/or measurement markings) 120. The portion 116' is shown having markings (e.g., ruler and/or measurement markings) 122. In some embodiments, only one of the portion 112' or the portion 116' may have measurement markings (e.g., not both).

The universal indicator tool 102' may be used by placing the indicator tool 102' on the wall 52 across the junction box 64. The portion 110 is shown close to the junction box 64 (e.g., closer than the example 150 described in FIG. 3). Having the portion 110 closer to the junction box 64 (e.g., by reducing a length of the portion 114) may allow the user to read the markings 120. In some embodiments, the portion 118 may also be closer to the junction box 64 to allow the user to read the markings 122. The wall 52 may be established as one end of the indicator tool 102'. A gap is shown between the portion 114 and the mounting screws 68*a*-68*b*. Since the universal indicator tool 102' may not be specific to a particular model of light fixture 54, the length of extension of the mounting screws 68*a*-68*b* may not be based on touching the mounting screws 68*a*-68*b* against the portion 114. For example, the user may press the portion 110 and the portion 118 against the wall 52 around the junction box 64 and the bracket 66 and extend the mounting screws 68*a*-68*b* until the length of extension of the mounting screws 68*a*-68*b* are even with the measured distances according to the markings 120 and/or 122.

The markings 120 and/or the markings 122 may comprise a number of precision markings and/or measurement distances (e.g., about 2 mm of spacing/precision). The markings 120 and/or the markings 122 may be used as a length indicator for adjusting the length of extension for the mounting screws 68*a*-68*b*. The markings 120 and/or the markings 122 may be numerical. The markings 120 and/or the markings 122 may be evenly spaced measurements of a particular distance. The number and/or types of the markings 120 and/or the markings 122 may be varied according to the design criteria of a particular implementation.

In some embodiments, the indicator tool 102' may be placed next to the base 56 with the locking nuts 62*a*-62*b* over the mounting holes 60*a*-60*b*. The user may read off the specific length marking for the particular model of light fixture 54. The markings 120 and/or the markings 122 may be used as the length indicator for the mounting screws 68*a*-68*b*. In some embodiments, the light fixture 54 may provide installation instructions for the length of extension of the mounting screws 68*a*-68*b*. The user may follow the instructions by adjusting the length of extension of the mounting screws 68*a*-68*b* by measuring using the markings 120 and/or 122.

Figure 7:
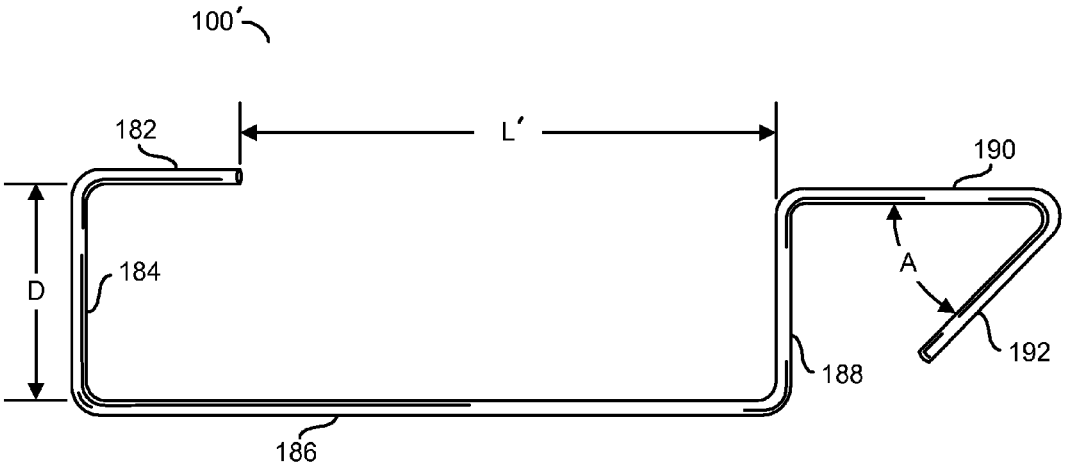
FIG. 7 is a diagram illustrating an alternate embodiment of an installation kit.

Referring to FIG. 7, a diagram illustrating an alternate embodiment of the installation kit 100' is shown. The alternate installation kit 100' may be a single tool comprising the indicator bar 102 and the hook tool 104. The alternate installation kit 100' is shown comprising a combined portion 182, a combined portion 184, a combined portion 186, a combined portion 188, a combined portion 190 and a combined portion 192. In one example, the combined portions 182-192 may define a plane (e.g., the kit 100' may lie flat). Arranging the combined portions 182-192 in a common plane may increase an efficiency of packaging of the installation kit 100'. In another example, one or more of the combined portions 182-192 may not define a plane. Generally, the portions 182-190 may be arranged to define a plane to ensure the installation kit 100' presses flat against the wall 52. The combined portion 192 may be directed above or below the plane defined by the combined portions 182-190. Directing the combined portion 192 above or below the plane defined by the combined portions 182-190 may allow the user to hook the light fixture 54 in a different orientation.

The combined portion 182 may be similar to the portion 110. The combined portion 184 may be similar to the portion 112. The combined portion 182 and the combined portion 184 may be similar to the hook portion 144. The combined portion 186 may be similar to the portion 114 and/or the hook portion 142. The combined portion 188 may be similar to the portion 116. The combined portion 190 may be similar to the portion 118 and/or the hook portion 142. The combined portion 192 may be similar to the hook portion 140.

The combined portion 182 may be at one end of the kit 100'. The combined portion 192 may be at another (e.g., the opposite) end of the kit 100'. The combined portion 182 may be connected perpendicularly to the combined portion 184. Generally, the unconnected end of the combined portion 182 points towards the combined portion 190.

The combined portion 184 is shown connected perpendicularly to the combined portion 182 and the combined portion 186. Generally, the connection of the combined portion 184 to the combined portion 182 and the connection of the combined portion 184 to the combined portion 186 point in the same direction (e.g., the combined portions 182-186 form a general 'U' shape).

The combined portion 186 is shown connected perpendicularly to the combined portion 184 and the combined portion 188. Generally, the connection of the combined portion 186 to the combined portion 184 and the connection of the combined portion 186 to the combined portion 188 point in the same direction (e.g., the combined portions 186-188 form a general 'U' shape).

The combined portion 188 is shown connected perpendicularly to the combined portion 186 and the combined portion 190. Generally, the connection of the combined portion 188 to the combined portion 186 and the connection of the combined portion 188 to the combined portion 190 point in opposite directions (e.g., the combined portions 186-190 form a general 'z' shape).

The combined portion 190 is shown connected perpendicularly to the combined portion 188. The combined portion 190 is shown connected to the combined portion 192 at the acute angle A. The connection of the combined portion 190 to the combined portion 192 may direct the combined portion 192 towards the combined portion 188 and the combined portion 186 (e.g., straight lines extending from the combined portions 186, 188 and 192 would intersect). The angle A may be selected such that the combined portion 192 may fit over (e.g., hook over and/or hang from) the bracket 66. Fitting the combined portion 192 over the bracket 66 may allow the kit 100' to provide support for an object (e.g., the light fixture 54) attached to the combined portion 192. A length of the combined portion 192 may be selected to provide enough space for the kit 100' to hang over the bracket 66 without slipping.

The combined portion 184 and the combined portion 188 are shown having a depth measurement D. The combined portion 184 and the combined portion 188 may have the same depth D. The depth D may offset the combined portion 186 from the combined portion 184 and the combined portion 190. The depth D may be equal to (or close to) at least a thickness of the wall mount base 56 of the light fixture 54 plus a depth of the locking nuts 62*a*-62*b*. In some embodiments, the depth D may be selected so that when the combined portion 182 and the combined portion 190 are set against the wall 52, the length of extension for the mounting screws 68*a*-68*b* may be adjusted until the mounting screws 68*a*-68*b* touch, or come close to touching, the combined portion 186. When the mounting screws 68*a*-68*b* touch the combined portion 186, the mounting screws 68*a*-68*b* may be at the precise length (e.g., within a range of 2 mm) to mount the light fixture 54 and attach the locking nuts 62*a*-62*b*.

The depth D may further be selected to correspond to a shape of the base 56. For example, the depth D may be configured to be wide enough for the combined portions 182-186 to reach around the base 56 so that the combined portions 182-186 can reach one of the mounting holes 60*a*-60*b*. The depth D may be selected based on a distance from one of the mounting holes 60*a*-60*b* to an edge of the base 56 of the light fixture 54.

The combined portion 186 is shown having a length L'. The length L' may not be the entire length of the combined portion 186. The length L' is shown as the distance from (e.g., a gap between) the combined portion 188 to the unconnected end of the combined portion 182. The length L' may be at least the same length as the bracket 66. For example, the combined portions 182-188 may be configured to fit around the bracket 66. Generally, the length L' will be longer than the length of the bracket 66.

The combined portion 182 and the combined portion 190 may be set against the wall 52 by the user. The junction box 64 should be between the unconnected end of the combined portion 182 and the combined portion 190 (e.g., within the gap L'). After the length of extension of the mounting screws 68*a*-68*b* is measured, the kit 100' may then be used to suspend the light fixture 54 in the air by hanging the combined portion 192 over the bracket 66 and the fitting the combined portion 182 through one of the mounting holes 60*a*-60*b*.

Figure 8:
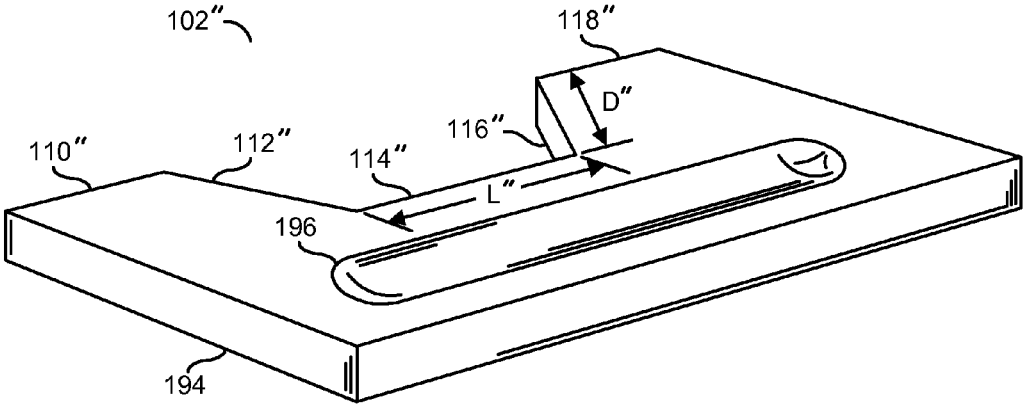
FIG. 8 is a diagram illustrating an alternate embodiment of an indication bar.

Referring to FIG. 8, a diagram illustrating an alternate embodiment of the indication tool 102" is shown. The indication tool 102" is shown having an edge 110", and edge 112", and edge 114", an edge 116", a solid material 194 and a depression 196. The edge 110" may be similar to the portion 110. The edge 112" may be similar to the portion 112. The edge 114" may be similar to the portion 114. The edge 116" may be similar to the portion 116. The edge 118" may be similar to the portion 118.

The indication tool 102" may be implemented using the solid piece of material 194, such as plastic and/or another type of lightweight material. The particular type of material 194 used to make the tool 102" may be varied to meet the design criteria of a particular implementation. The solid piece of material 194 may be a portion used to hold the tool 102". For example, the tool 102" may be formed in a handheld sized block. In some embodiments, the tool 102" may be formed for a one-handed use.

The depression 196 may be a carved out section of the solid piece of material 194. The depression 196 may be implemented to allow the user to grip the indication tool 102" (e.g., provide a grip the tool 102" for the user with one hand). For example, the depression 196 may be sized to approximately a typical size of fingers of an average person. The solid material 194 and the depression 196 may allow the indication tool 102" to be held more comfortably and/or measure the extension of the mounting screws 68*a*-68*b* without the indication tool 102" slipping through the fingers of the user.

The edge 110" may be at one end of the tool 102". The edge 118" may be at another end (e.g., the opposite end) of the tool 118". The edge 110" and the edge 118" may be pressed against the wall 82 by the user while the user adjusts the length of extension of the mounting screws 68*a*-68*b*.

The edge 110" is shown connected to the edge 112" at an obtuse angle. In some embodiments, the edge 110'" may be connected to the edge 112" at a perpendicular angle. The edge 112" is shown connected to the edge 114" at a reflex angle. In some embodiments, the edge 112" may be connected to the edge 114" at a perpendicular angle. Generally, the connection between the edge 110", the edge 112", and the edge 114" may form a slope down from (e.g., a negative slope with respect to) the edge 110" to the edge 114".

The edge 114" is shown connected to the edge 116" at a reflex angle. In some embodiments, the edge 114" may be connected to the edge 116" at a perpendicular angle. The edge 116" is shown connected to the edge 118" at an obtuse angle. In some embodiments, the edge 116" may be connected to the edge 118" at a perpendicular angle. Generally, the connection between the edge 114", the edge 116" and the edge 118" may form a slope up from (e.g., a positive slope with respect to) the edge 114" to the edge 118". The edges 110"-118" may form a carved out (e.g., cutout) section of the block material 194.

The edge 112" and the edge 116" have a depth measurement D". The edge 112" and the edge 116" may have the same depth D". The depth D" may be a depth of the cutout section of the tool 102". The depth D" may offset the edge 114" from the edge 110" and the edge 118". The depth D" may be equal to at least a thickness of the wall mount base 56 of the light fixture 54 plus a depth of the locking nuts 62*a*-62*b*. In some embodiments, the depth D" may be selected so that when the edge 110" and the edge 118" are set against the wall 52, the length of extension for the mounting screws 68*a*-68*b* may be adjusted until the mounting screws 68*a*-68*b* touch the edge 114". When the mounting screws 68*a*-68*b* touch, or come close to touching the edge 114", the mounting screws 68*a*-68*b* may be at the precise length (e.g., within a range of 2 mm) to mount the light fixture 54 and attach the locking nuts 62*a*-62*b*.

The edge 114" is shown having a length L". The length L" may be a length of the cutout section of the tool 102". The length L" may be at least the same length as the bracket 66. For example, the edge 112", the edge 114" and the edge 116" may be configured to fit around the bracket 66. Generally, the length L" will be longer than the length of the bracket 66 and/or the junction box 64.

Figure 9:
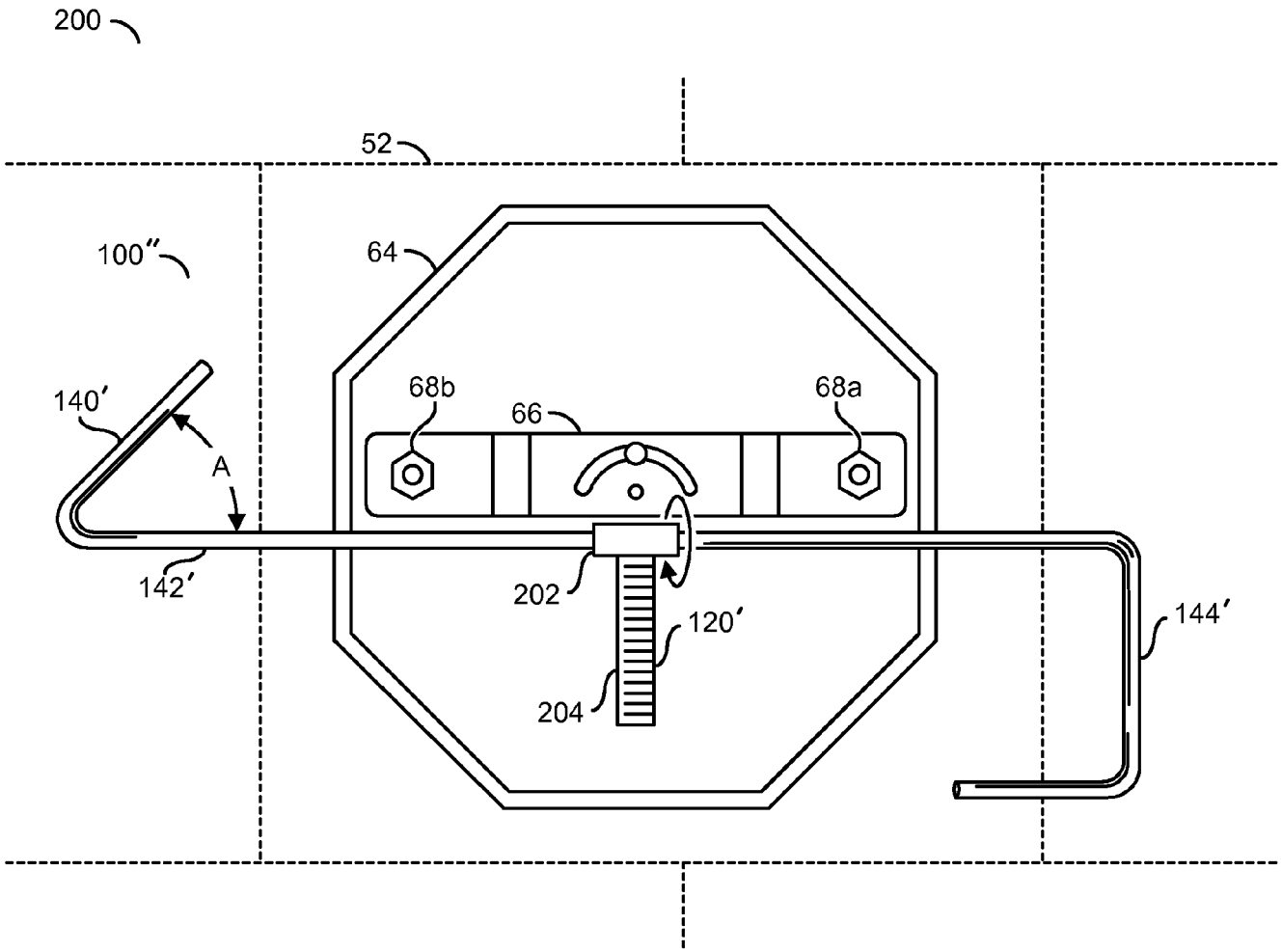
FIG. 9 is a diagram illustrating an alternate embodiment of an installation kit.

Referring to FIG. 9, a diagram illustrating example 200 of an alternate embodiment 100" of the installation kit 100 is shown. The alternate embodiment 100" is shown having a hook portion 140', a hook portion 142', a hook portion 144', a collar 202 and a guide 204. The guide 204 is shown attached to the collar 202. The guide 204 is shown having markings 120'. The alternate embodiment 100" may be a universal indicator (e.g., not specific for one type of light fixture 54). For example, the alternate embodiment 100" may be sold as an accessory.

The hook portion 140', the hook portion 142' and the hook portion 144' may implement the functionality of the hook tool 104 (e.g., as described in FIG. 2). The collar 202 and the guide 204 may implement the indication functionality of the indication bar 102 (e.g., for determining the length of extension of the mounting screws 68*a*-68*b*).

The collar 202 may be rotatable. Rotating the collar 202 may allow the attached guide 204 to point in various directions. For example, the collar 202 may be rotated to a range of 90 degrees or more. The collar 202 may be rotated by the user to point out (e.g., perpendicularly) from the wall 52. The markings 120' may be precision markings (e.g., having approximately 2 mm spacing). Placing the guide 204 near the mounting screw 68*a* and/or the mounting screw 68*b* may allow the user to measure the length of extension of the mounting screws 68*a*-68*b*. In some embodiments, the collar 202 may be configured to slide along the hook portion 142' (e.g., to be placed closer to the mounting screws 68*a*-68*b*).

The installation kit 100" is shown lying flat against the wall 52 and across the junction box 64. A length of the hook portion 142' may be selected to be larger than a width of the junction box 64 to allow the installation kit 100" to extend across the junction box 64 and be pressed up against the wall 52. The collar 202 may be rotated to align the guide 204 with the direction of the mounting screws 68*a*-68*b*. The length of extension of the mounting screws 68*a*-68*b* may be measured according to the markings 120' (e.g., measurements indicated) on the guide 204.

In some embodiments, the alternate installation kit 100'" may be placed next to the base 56 of the fixture 54. For example, the user may not know the length of extension of the mounting screws 68*a*-68*b* up front (e.g., no instructions are provided and/or the installation kit 100" is sold separately as a universal tool). The base 56 and the locking nuts 62*a*-62*b* may be used to determine an appropriate length of extension for the mounting screws 68*a*-68*b*. After determining the appropriate length of extension for the mounting screws 68*a*-68*b*, the user may use the guide 204 to adjust the length of extension of the mounting screws 68*a*-68*b* to the appropriate length.

After the user sets the length of extension of the mounting screws 68*a*-68*b*, the user may hang the installation kit 100" onto the bracket 66 using the hook portion 140'. The user may attach the hook portion 144' to the base 56 of the light fixture 54. The light fixture 54 may be suspended (as described in FIGS. 4-5) to allow the user to connect the wiring. The collar 202 may be rotated to move the guide 204 as preferred by the user (e.g., out of the way of the wiring) while the user connects the wiring.

Figure 10:
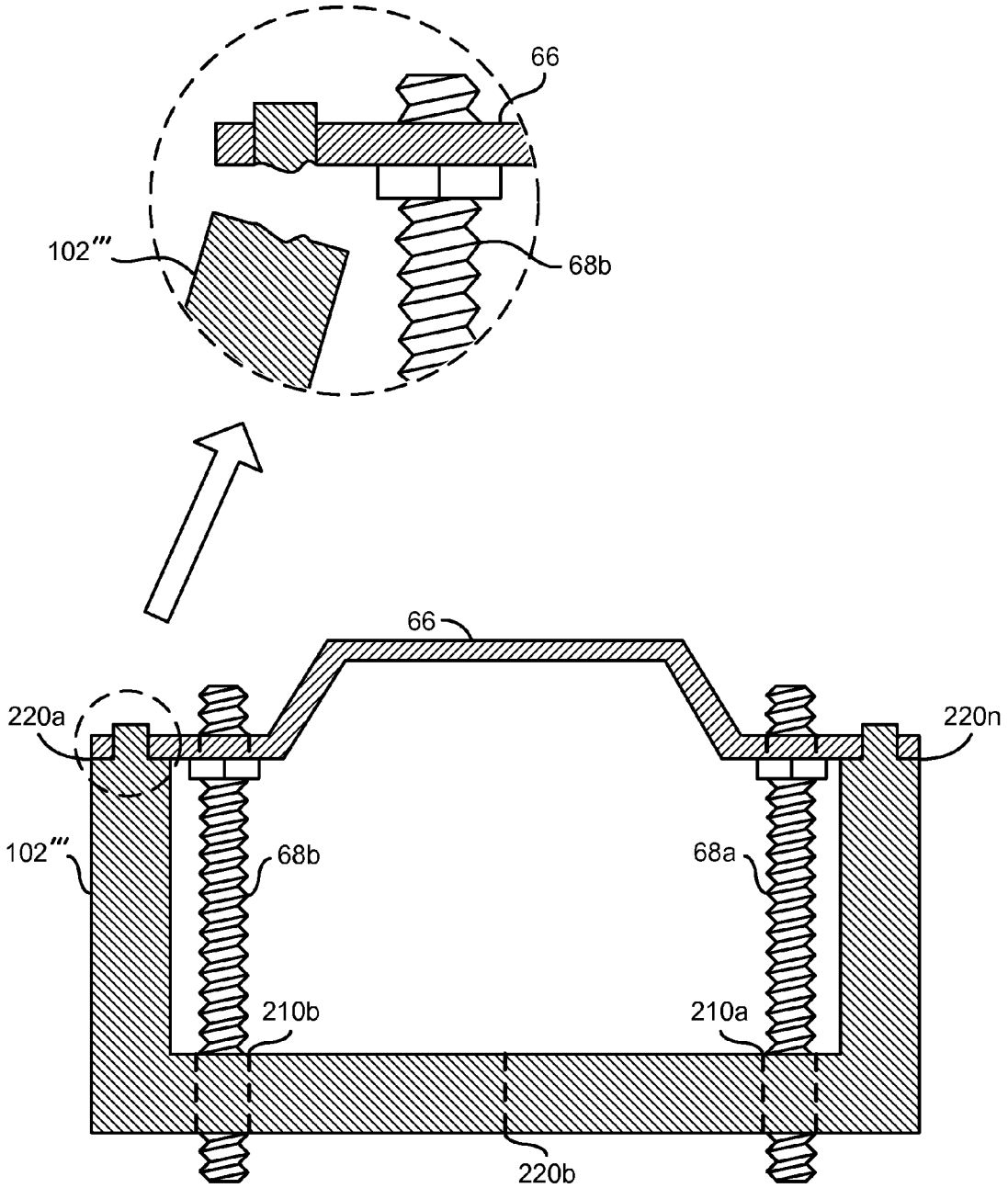
FIG. 10 is a diagram illustrating a disposable embodiment of the indication bar.

Referring to FIG. 10, a diagram illustrating an alternate embodiment of the installation tool 102'" is shown. For example, the installation tool 102'" may be formed similarly to the tool 102" (as described in FIG. 8). The tool 102'" may be fabricated along with the bracket 66. The tool 102'" may have a threaded portion 210*a* and a threaded portion 210*b* extending through the tool 102'". The threaded portion 210*a* and the threaded portion 210*b* may allow the mounting screws 68*a*-68*b* to be held in place during the installation of the bracket 66. After adjustment of the mounting screws 68*a*-68*b*, the tool 102'" may be cut away (e.g., snapped off, broken off, etc.) from the mounting screws 68*a*-68*b*.

In another example, the tool 102'" may have a number of portions 220*a*-220*n* that may be manufactured to be intentionally weak (e.g., have intentional weak points). For example, a material used to manufacture the tool 102'" may be perforated at the portions 220*a*-220*n*. The portions 220*a*-220*n* may allow the tool 102'" to be broken away from the bracket 66 at the intentional weak points without the need for additional tools. For example, the tool 102'" may be broken away from the bracket 66 by hand. In such an example, the tool 102'" would be a one time use tool.

In yet another example, the tool 102'" may further comprise hooks and/or attachment mechanisms (e.g., attached at the end of the portion 220*a* and/or the end of the portion 220*n*). The hooks and/or attachment mechanisms may allow the tool 102'" to removably attach to the bracket 66. The hooks and/or attachment mechanisms may fit over the bracket 66. For example, the bracket 66 and the tool 102'" may be sold separately and/or made from different materials. The hooks and/or attachment mechanisms may allow the tool 102'" to hang from the bracket 66 while the threaded portions 210*a*-210*b* line up with the mounting screws 68*a*-68*b*. After the length of extension of the mounting screws 68*a*-68*b* is set, the tool 102'" may be broken off and discarded.

The installation kit 100 may provide an easy to use tool kit to install a wall mounted light fixture 54. Generally, wall mounted light fixtures (e.g., the light fixture 54) are sold at high volume and a low price point in the DIY market. Providing the installation kit 100 (along with the wall mounted light fixture 54) at a low price point may help home owners easily install the light fixtures 54. Universal embodiments of the installation kit 100 and/or the tools (e.g., indication bar 102' described in FIG. 6, the combined tool 100" described in FIG. 9, etc.) may be useful universal tools for professional workers who install many different models (e.g., sizes, weights, shapes, etc.) of light fixtures. The universal embodiments may save time and prevent frustration for the users who install many light fixtures.

The installation kit 100 may save about one hour of time for a typical DIY home owner. The installation kit 100 and/or the individual tools (e.g., the indication bar 102 and/or the hook 104) may eliminate frustration with respect to having to perform several trial and error attempts to get the screw length correct (e.g., to within 2 mm). Each trial attempt involves the user redoing the mounting of a bulky and/or heavy light fixture.

While the invention has been particularly shown and described with reference to the preferred embodiments thereof, it will be understood by those skilled in the art that various changes in form and details may be made without departing from the scope of the invention.

The invention claimed is:

1. An apparatus configured to indicate a length of extension for screws extending from a bracket, comprising:

(A) a first portion at one end of said apparatus, (B) a second portion having a depth, (C) a third portion having a length, (D) a fourth portion having said depth; and (E) a fifth portion at another end of said apparatus, wherein (i) said first portion is connected perpendicularly to said second portion, (ii) said second portion is connected perpendicularly to said third portion, (iii) said third portion is connected perpendicularly to said fourth portion and away from said first portion, (iv) said fourth portion is connected perpendicularly to said fifth portion and away from said first portion, (v) said first portion, said second portion, said third portion, said fourth portion and said fifth portion are arranged in a common plane, (vi) said length of said third portion is at least a same length as said bracket (vii) said first portion and said fifth portion are arranged in a line and (viii) said depth offsets said third portion from said first portion and said fifth portion by a distance equal to a thickness of a base of a light fixture plus a depth of a locking nut for said screws.

2. The apparatus according to claim 1, wherein said length and said depth of said apparatus are selected for installing a particular model of said light fixture.

3. The apparatus according to claim 1, wherein at least one of said second portion and said fourth portion have markings.

4. The apparatus according to claim 3, wherein said markings provide measurement distances for adjusting said length of said screws extending from said bracket.

5. The apparatus according to claim 4, wherein said measurement distances provide at least a 2 mm precision.

6. The apparatus according to claim 3, wherein said apparatus is a universal tool for installing a plurality of models of said light fixture.

7. The apparatus according to claim 1, wherein said length of extension of said screws extending from said bracket is determined by (i) a user pressing said first portion and said fifth portion against a wall around said bracket and (ii) extending said screws from said bracket until said screws touch said third portion of said apparatus.

8. The apparatus according to claim 1, wherein said apparatus is a first tool of an installation kit and a second tool of said installation kit comprises:

(A) a first hook portion at one end of said second tool;

(B) a second hook portion; and (C) a third hook portion at another end of said second tool, wherein (i) said first hook portion, said second hook portion and said third hook portion define a plane, (ii) said first hook portion is connected at an acute angle with said second portion, (iii) said second hook portion is connected perpendicularly with said third hook portion and away from said first hook portion, (iv) said third hook portion has a perpendicular bend directed towards said first hook portion, (v) said first hook portion is configured to fit over said bracket, (vi) a width of said third hook portion corresponds to a distance of a mounting hole of said light fixture to an edge of said base of said light fixture and (vii) said third hook portion is configured to fit into said mounting hole of said base of said light fixture.

9. An apparatus used for installing a light fixture, comprising:

a first portion used to hold said apparatus; and a second portion having a first edge, a second edge, a third edge, a fourth edge and a fifth edge, wherein (i) said second edge, said third edge and said fourth edge form a cutout of said apparatus, (ii) a depth of said cutout offsets said third edge from said first edge and said fifth edge by a distance equal to at least a thickness of a base of a light fixture plus a depth of a locking nut for one or more screws used for mounting said light fixture, (iii) a length of said cutout is at least a same length as a bracket used for mounting said light fixture and (iv) said first portion and said second portion are formed in a handheld sized block.

10. The apparatus according to claim 9, wherein said first portion further comprises a depression to provide grip for a user.

11. The apparatus according to claim 9, wherein a material of said apparatus is plastic.

12. The apparatus according to claim 9, wherein said third edge comprises one or more apertures for a corresponding number of threaded portions extending through said apparatus.

13. The apparatus according to claim 12, wherein said threaded portions are configured to receive mounting screws for installing said light fixture extending from a bracket.

14. The apparatus according to claim 9, wherein said first edge and said fifth edge comprise hooks, said hooks configured to fit over a bracket used to install said light fixture.

15. The apparatus according to claim 9, wherein (i) said apparatus has one or more intentional weak points and (ii) said intentional weak points are used to break said apparatus after calibrating a length of extension of said screws.

16. An apparatus for installing a light fixture, comprising:

(A) a first portion at one end of said apparatus;

(B) a second portion having a depth;

(C) a third portion;

(D) a fourth portion having said depth;

(E) a fifth portion; and (F) a sixth portion at another end of said apparatus, wherein (i) said first portion, said second portion, said third portion, said fourth portion and said fifth portion define a plane, (ii) said first portion is connected perpendicularly to said second portion, (iii) said second portion is connected perpendicularly to said third portion and in a same direction as said connection of said second portion to said first portion, (iv) said third portion is connected perpendicularly to said fourth portion and in a same direction as said connection of said third portion to said second portion, (v) said fourth portion is connected perpendicularly to said fifth portion and away from said first portion, (vi) said fifth portion is connected at an acute angle with said sixth portion directed towards said third portion and said fourth portion, (vii) said sixth portion is configured to fit over a bracket used to mount said light fixture, (viii) said first portion and said fifth portion define a line, (ix) said first portion is configured to fit into a mounting hole of a base of said light fixture, (x) a gap length between an unconnected end of said first portion and said connection between said fourth portion and said fifth portion is at least a same length as said bracket, (xi) said depth corresponds to a distance of said mounting hole of said light fixture to an edge of said base of said light fixture and (xii) said depth offsets said third portion from said first portion and said fifth portion by at least a distance equal to a thickness of said base of a light fixture plus a depth of a locking nut for mounting screws extending from said bracket.

* * * * *